US005146270A

United States Patent [19]

Matsuo et al.

[11] Patent Number: 5,146,270

[45] Date of Patent: Sep. 8, 1992

[54] COLOR IMAGE FORMING APPARATUS HAVING INTERCHANGEABLE IMAGE FORMING PROCESS CARTRIDGES

[75] Inventors: Shunji Matsuo; Sizuo Morita; Satoshi Haneda; Masakazu Fukuchi; Hisashi Shoji, all of Hachioji, Japan

[73] Assignee: Konica Corporation, Tokyo, Japan

[21] Appl. No.: 686,877

[22] Filed: Apr. 16, 1991

Related U.S. Application Data

[63] Continuation of Ser. No. 453,815, Dec. 19, 1989, abandoned.

[30] Foreign Application Priority Data

Dec. 27, 1988 [JP] Japan ..... 63-332040
Jan. 17, 1989 [JP] Japan ..... 1-9540

[51] Int. Cl.[5] ..... G03G 15/00

[52] U.S. Cl. ..... 355/200; 355/210; 355/271; 355/277; 355/298

[58] Field of Search ..... 355/200, 202, 260, 210, 355/211, 271, 274, 277, 298, 326–327, 245; 118/644, 652, 653

[56] References Cited

U.S. PATENT DOCUMENTS

| | | | |
|---|---|---|---|
| 4,162,843 | 7/1979 | Inoue et al. | 355/327 |
| 4,386,838 | 6/1983 | Hirabayashi et al. | 355/202 X |
| 4,456,363 | 6/1984 | Hirabayashi | 355/274 X |
| 4,751,552 | 6/1988 | Itoigawa | 355/200 |
| 4,768,055 | 8/1988 | Takamatsu et al. | 355/298 |
| 4,864,367 | 9/1989 | Nakahara et al. | 355/272 |

FOREIGN PATENT DOCUMENTS

| | | | |
|---|---|---|---|
| 0240168 | 10/1987 | European Pat. Off. | 355/271 |
| 0150782 | 11/1981 | Japan | 355/298 |
| 0151983 | 9/1982 | Japan | 355/200 |
| 0201272 | 12/1982 | Japan | 355/277 |
| 58-182682 | 10/1983 | Japan . | |
| 60-239786 | 11/1985 | Japan . | |
| 61-205956 | 9/1986 | Japan . | |
| 0047684 | 3/1987 | Japan | 355/298 |
| 0085684 | 4/1988 | Japan | 355/298 |
| 0097984 | 4/1988 | Japan | 355/298 |
| 0271273 | 11/1988 | Japan | 355/271 |
| 2091640A | 8/1982 | United Kingdom . | |

*Primary Examiner*—A. T. Grimley
*Assistant Examiner*—T. A. Dang
*Attorney, Agent, or Firm*—Frishauf, Holtz, Goodman & Woodward

[57] ABSTRACT

A color image forming apparatus wherein an image retainer and a transfer member are arranged unitarily in a process cartridge, the process cartridge being formed so that it can be inserted into and withdrawn from an apparatus body having a pluralilty of developing devices. The process cartridge has a cleaning device and a transfer member, and the apparatus body has a device for recovering waste toner. The waste toner scraped off from a surface of the image retainer by the cleaning device is recovered into a hollow in the transfer member.

9 Claims, 11 Drawing Sheets

COLOR IMAGE FORMING APPARATUS HAVING INTERCHANGEABLE IMAGE FORMING PROCESS CARTRIDGES

This application is a continuation of U.S. patent application Ser. No. 07/453,815, filed Dec. 19, 1989, now abandoned.

BACKGROUND OF THE INVENTION

1. Field of the Invention

This invention relates to a color image forming apparatus having a color process cartridge capable of being inserted into and withdrawn from an apparatus body, and discarded when it reaches the limit of use.

2. Description of the Prior Art

The conventional color image forming apparatuses using a transfer drum is disclosed in Japanese Patent Laid-Open No. 61-123257 In the apparatus disclosed in this laid-open publication, a color image is formed by reading a document, modulating a laser beam by a digital signal obtained and writing the information on an image retainer to form an electrostatic latent image thereon, developing this image by a rotary type color developing device, and transferring the toner images of various colors obtained to a transfer paper on a transfer drum sequentially to fix the same thereon Japanese Patent Laid-Open No. 58-72159 proposes a transfer drum type color image forming apparatus having a process cartridge in which an image retaining drum, a plurality of developing devices and a cleaning device are unitarily incorporated This laid-open publication includes a statement to the effect that the apparatus may also have an interchangeable black-and-white image forming process cartridge.

Since the image retaining drum, developing devices and cleaning device are incorporated in the cartridge as stated in Japanese Patent Laid-Open No. 58-72159, a user can prevent an unnatural copying operation which causes scatter of the quality of the images obtained, and the manufacturer can easily guarantee the quality of their products.

However, when it becomes necessary in the apparatus disclosed in this laid-open publication to carry out, for example, the inserting and withdrawing of the process cartridge, the remedying of a jam and the replacement of parts, the image retaining drum and transfer drum have to be separated from each other in the apparatus. This makes it difficult to smoothly carry out the above-mentioned operations, and the necessity of providing a space large enough to carry out the separation of these drums causes the dimensions of the apparatus to increase. Especially, the positioning of the image retaining drum and transfer drum which is done after the completion of the above-mentioned operations of inserting and withdrawing the process cartridge, remedying a jam and replacing parts tends to lack accuracy, so that the imperfect image transfer and the doubling of different color image portions occur.

A cartridge in which an image retaining drum and a transfer drum are arranged is discarded when it reaches the limit of use. In view of the manufacturing cost of the cartridge, it is desirable that the cartridge be discarded on the basis of the lifetime of the image retaining drum.

The lifetime of the image retaining drum is usually supposed to be 50000–80000 in terms of number of color copies taken, and, during the lifetime, a copying operation continues to be carried out by replacing the developing devices and supplementing the toner.

Besides these problems, the waste toner scraped off by a cleaning blade from the image retaining drum, which has been subjected to an image transfer operation, is deposited in the cleaning device every time a copy is taken, and the originally small cleaning chamber shortly becomes unable to hold such waste toner. To eliminate this inconvenience from a conventional apparatus of this kind, a method of transferring the waste toner accumulated in the cleaning chamber, by a screw conveyor to a toner recovery box provided in the apparatus body, or a method of withdrawing a waste toner recovery cylinder inserted in the cleaning chamber is employed to throw away such toner. However, in the case where the waste toner recovery box is used, the insertion and withdrawal of the cartridge become troublesome since it is necessary to transfer the waste toner to the outside of the cartridge by the screw conveyor. In the case where the waste toner recovery cylinder is used, much labor and much copying time are required since it is necessary to interrupt a copying operation every time the recovery cylinder is withdrawn and inserted.

For example, Japanese Patent Laid-Open No. 61-140357 proposes the techniques for recovering the waste toner from an image retaining drum into the hollow therein by a screw conveyor.

With the recent spread of copiers, the development of a light, popular miniaturized machine has been demanded. Accordingly, the miniaturization of the image retaining drum has also been studied, and an image retaining drum having a small diameter of not more than 100 mm has usually been used. Therefore, the substantial capacity of the waste toner-holding hollow in the image retaining drum is small, so that this drum has a practical problem.

SUMMARY OF THE INVENTION

An object of the present invention is to provide a color image forming apparatus capable of preventing the occurrence of imperfect transfer of an image and the doubling of different color image portions, and ensuring the stable quality of a color image. Another object of the present invention is to provide a color image forming apparatus capable of switching a color image copying mode to a black-and-white image copying mode and having a structure in which image forming devices and a transfer member are arranged compactly.

These objects can be achieved by a color image forming apparatus having an image retainer and a transfer member, at least the image retainer and transfer member being arranged unitarily in a process cartridge, this cartridge being formed so that it can be inserted into and withdrawn from an apparatus body.

The color image forming apparatus according to the present invention is adapted to form a color image by an each-time transfer system using a transfer member and characterized in that a process cartridge in which an image retainer and a transfer member, and at need a plurality of developing devices, a cleaning device and a charging device etc. are arranged unitarily is provided so that the cartridge can be inserted into and withdrawn from an apparatus body so as to ensure the quality of a color copy and obtain a compact apparatus.

This color image forming apparatus is further characterized in that it is constructed so that a mode of obtaining color copies can be switched to a mode of obtaining black-and-white copies which have a great demand, by replacing preferably the cartridge, or the modular developing devices in some cases.

In the case where a process cartridge containing unitarily at least an image retainer and a transfer member is employed, variations do not occur in the positioning of the image retainer and transfer member. Accordingly, the accuracy of registering toner images of various colors becomes high, and a color copy of a high resolution can be obtained. In addition, a jam on the transfer member, such as the imperfect feeding of transfer paper, which is peculiar to the transfer member, can be remedied easily, and there are many other advantages. On the other hand, the transfer member requires transfer paper to be wound therearound, and the transfer member for feeding, for example, A-3 size transfer paper is necessarily formed to a large diameter of 150 mm. Therefore, the dimensions of the process cartridge containing the transfer member in addition to the image retainer, developing devices, cleaning device and charging device increase, and the cost of manufacturing the cartridge becomes comparatively high.

According to the present invention, a toner chamber in which not less than 50 g, preferably, not less than 100 g of toner is sealed is provided preferably in each developing device, and, when the sealed toner is consumed, the developing devices are replaced separately by another toner-sealed developing device or altogether by another unit of toner-sealed developing devices so as to continue the copying operations until the process cartridge reaches its limit of use. The supplementing of the toner is done by carrying out the insertion and withdrawal of a toner supply cylinder into and from each developing device, or feeding the toner from a toner supply hopper, which is provided outside the apparatus, to the toner supply port of the process cartridge by a screw conveyor, whereby the copying operations are carried out continuously until the cartridge reaches its limit of use.

When a copying operation is carried out for a long period of time, it becomes necessary that the waste toner accumulated in the cleaning device be recovered at the outer side of the apparatus. To meet this requirement, the waste toner in the cleaning device is recovered therefrom, for example, into the hollow in the image retainer or transfer member by using a spring coil, or into a waste toner recovery box, which is provided at the outer side of the apparatus, by a transfer means, such as a screw conveyor, or into a waste toner recovery cylinder adapted to be inserted into and withdrawn from the cleaning device.

The limit of use of the process cartridge is set on the basis of the lifetime of the image forming device, for example, a carrier and an image retainer. The life time of, for example, a spherical carrier made by coating a ferrite core with a resin is said to be around 50000 in terms of number of copies taken, and that of an image retainer consisting of an improved OPC photosensitive body around 80000 in terms of number of copies taken. The cartridge is replaced on the basis of such a lifetime. In order to set the time of replacement, a special mark is put on each cartridge, and the characteristics of this mark are read by a reading device the moment the cartridge is mounted on an image forming apparatus. In accordance with a signal representative of what is thus read, the copying operation is interrupted by controlling a driving power source, and the replacement of the cartridge is then carried out.

The mark referred to above may consist of an electromagnetic mark, a color mark and a bar code. Also, different cartridges may be provided with projections of different configuration, by which a microswitch is turned on to output a signal peculiar to the projections of each configuration. Usually, a limit number of copies representative of the limit of use of the cartridge in use is read from a memory, on which the limit numbers of copies corresponding to the marks on various cartridges are stored in advance, through a CPU in accordance with a signal representative of a read mark. The read number of copies representative of the limit of use of the cartridge and the ordinal number of the copy being taken are then compared. When this ordinal number reaches the number of copies representative of the limit of use of the cartridge, an alarm lamp is lit to stop the copying operation. A method of checking the densities of the various colors of the color patches of a toner image formed on an image retainer may also be used. According to this method, when the densities of the colors of such patches become lower than predetermined levels, the copying operation is stopped to renew the cartridge.

Still another object of the present invention is to provide a color image forming apparatus which is capable of being made to small dimensions and obtaining color copies of a stable quality owing to the employment of a process cartridge containing image forming devices including an image retainer, a plurality of developing devices and a cleaning device, and a transfer member, and which is free from, especially, the imperfect registration of an image which causes the color of a copied image to be darkened. A further object of the present invention is to provide a color image forming apparatus employing a process cartridge of a lower manufacturing cost and an improved practicality, and, especially, capable of carrying out a waste toner recovering operation so smoothly as to reduce the copying time.

These objects can be achieved by a color image forming apparatus having a plurality of developing devices, a cleaning device and a transfer member which are provided around an image retainer, at least the image retainer, cleaning device and transfer member being arranged unitarily in a process cartridge, which is constructed so that the cartridge can be inserted into and withdrawn from an apparatus body, the apparatus being further provided with a means for recovering the waste toner, which is scraped off from the surface of the image retainer by the cleaning device, into the hollow in the transfer member.

This color image forming apparatus according to the present invention is adapted to form a color image by an each-time transfer system using a transfer member, and characterized in that a process cartridge in which an image retainer, a cleaning device and a transfer member, and at need, a plurality of developing devices and a charging device etc. are arranged unitarily so as to ensure the quality of a color copy and make the apparatus compact is provided so that the cartridge can be inserted into and withdrawn from an apparatus body, and in that the residual toner scraped off from the surface of the image retainer which has been subjected to an image transfer operation, by a cleaning blade is recovered into the hollow in the transfer member by using, for example, a screw conveyor or a spring coil.

In this embodiment of the present invention, the waste toner accumulated in the cleaning device is recovered continuously therefrom into a large-capacity hollow in the transfer member, and, moreover, this recovery operation continues to be carried out until the process cartridge reaches its limit of use. This renders it unnecessary to interrupt prior to the cartridge replacing time the copying operation for the purpose of recovering the waste toner, and provide a waste toner transfer means on the outer side of the cartridge.

The developer used in the present invention may be either a one-component developer containing magnetic toner as a main component or a two-component developer consisting of a magnetic carrier and non-magnetic toner. In order to secure the clearness of the tone of the coloring agent contained in the toner, the two-component developer is preferably used.

The color image forming process cartridge used in the color image forming apparatus according to the present invention may consist of a full color image forming cartridge or a functional color image forming cartridge, and have as a spare cartridge a cartridge exclusively used to obtain black-and-white copies.

Referring to FIGS. 1A-1I, a reference numeral 1 denotes an image retaining drum, 2 a charging device, 3, 3*a*, 3*b*, 3*c*, 3*d*, 3*e* various types of full color and functional color image forming process cartridges, 3*f*, 3*g*, 3*h* process cartridges exclusively used to obtain black-and-white copies, 4 a hollow rotary shaft of the image retaining drum 1, 5 a transfer drum, 6 a Y (yellow) developing device, 7 a M (magenta) developing device, 8 a C (cyan) developing device, 9, 9', 9'' a BK (black) developing device, 9*b* a BK toner supply chamber, 10 a R (red) developing device, 11 a B (blue) developing device, 6*a* a Y toner supply cylinder, 7*a* a M toner supply cylinder, 8*a* a C toner supply cylinder, 9*a* a BK toner supply cylinder, 10*a* a R toner supply cylinder, and 11*a* a B toner supply cylinder.

A reference numeral 12 denotes a cleaning device, 12*b* a collector in which the waste toner scraped off by a blade 12*a* is collected, 17 a spring coil for recovering the collected waste toner into the image retaining drum, 14 a gripper for fixing transfer paper to the transfer drum 5, 15 a discharge port for sending out therefrom the transfer paper, which is separated from the transfer drum, into a fixing device, and 16 an inlet port for introducing the transfer paper therefrom onto the transfer drum 5.

The copying mode is switched from a full color image copying mode to a functional color copying mode or a black-and-white image copying mode by replacing the process cartridge in use by another, and, during this time, the image forming mode is also changed. It is therefore preferable to utilize an IC card on which the information on the image forming mode peculiar to each cartridge and the number of copies representative of the limit of use of the cartridge, are provided.

The developing devices set in the process cartridge are made modular so that these devices can be inserted into and withdrawn from the cartridge, and a copying operation may be carried out continuously by replacing the unit developing device instead of carrying out a toner supplementing operation. Unit developing devices for full color images, functional color images and black-and-while images may be prepared so as to change the image forming mode by interchanging these developing devices. When the unit developing device is replaced by another, it is necessary to change the IC card provided in the cartridge be changed to an IC card of a new mode.

The insertion and withdrawal of a process cartridge into and from the apparatus body of the color image forming apparatus according to the present invention are carried out with a front door on the apparatus body opened. In order to carry out the replacing of the parts and the remedying of a jam easily, the apparatus body may consist of a clamshell structure. The image forming process may employ an analog system in which a simple reading system is used, or a digital system in which the changing of the quality of an image and the editing of an image can be done easily.

FIGS. 1J-1R show other type process cartridges used in the present invention, in which the parts identical with those of the above-described examples are designated by the same reference numerals. A reference numeral 17' denotes a spring coil for recovering the collected waste toner into a transfer drum 5, and 18 a hollow rotary shaft, which has a plurality of toner dropping holes, of the transfer drum.

FIGS. 1S and 1T are other type process cartridges of the present invention, wherein the parts similar to those of the above-described embodiments are designated by the same reference numerals. Reference numerals 3*i* and 3*j* show process cartridges, respectively, wherein a developing unit 1000 is mounted separately. The process cartridge shown in each of FIGS. 1S and 1T corresponds in construction to that shown in each of FIGS. 1B and 1K, respectively. However, it is not limited thereto and it may be adapted in construction to the other embodiments described above.

The above and other objects as well as advantageous features of the invention will become apparent from the following description of the preferred embodiments taken in conjunction with the accompanying drawings.

DESCRIPTION OF THE PREFERRED EMBODIMENTS:

(Example 1)

Figure 2A:
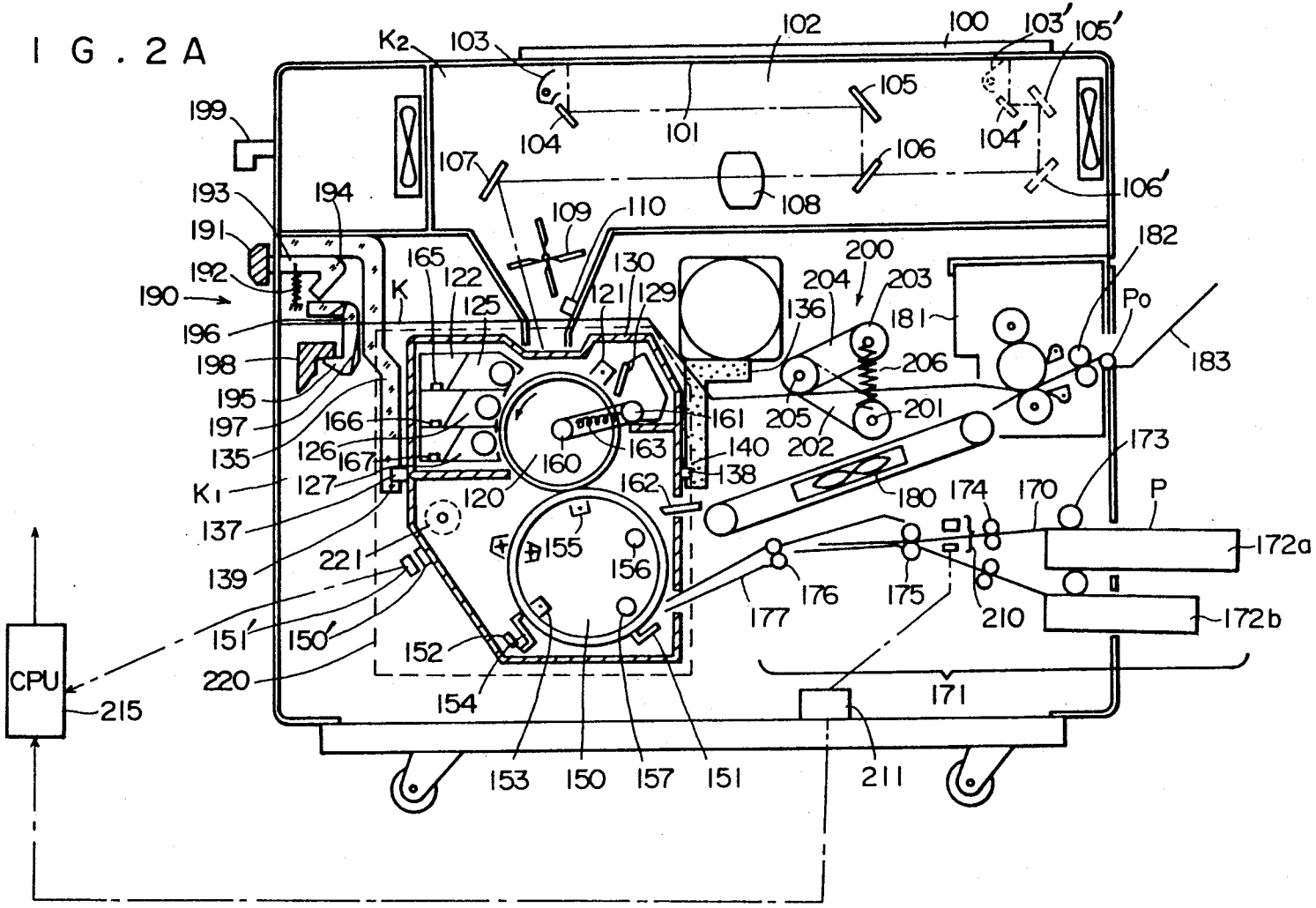
FIGS. 2A and 2B are a sectional view of a color image forming apparatus for explaining an embodiment of the present invention, and a sectional view of a principal portion of the apparatus.

FIG. 2A is a sectional view of a color image forming apparatus for describing an embodiment of the present invention, which has a clamshell structure and employs an analog system. In this embodiment, a full color image copying operation was carried out with a process cartridge having full color developing devices for three colors, Y, M, C, until the cartridge reached its limit of use, and the cartridge was then replaced by a process cartridge having a BK developing device alone, whereby an operation of taking black-and-white copies was carried out until this cartridge reached its limit of use.

Referring to FIG. 2A, a reference numeral 100 denotes a color document, 101 a document glass plate, and 102 an image exposing optical system, which consists of a light source 103, reflecting mirrors 104–107, a lens 108, filters 109 for B, G, R, Nd, and a filter detector 110.

Reference numerals 103'; 104'–106' represent the positions occupied by the light source and reflecting mirrors in the optical system after they are moved. A full color image copying process cartridge 130 contains therein an image retaining drum 120, a charging device 121, developing devices 122, which consist of a Y developing device 125, a M developing device 126 and a C developing device 127, a cleaning device 129 and a transfer drum 150. Toner supply cylinders 165, 166, 167 are installed in the Y developing device, M developing device and C developing device so that these cylinders can be inserted into and withdrawn from the respective developing devices. The cleaning device is provided with a waste toner collector 161. The waste toner brought together in the collector 161 is transferred to a hollow rotary shaft 160 of the image retaining drum by a spring coil 163 and recovered therefrom into the hollow in the image retaining drum via a plurality of toner dropping holes made in the rotary shaft. The transfer drum has a gripper 151 for fixing an end portion of the transfer paper thereto, a presser 154 for pressing the transfer paper against the transfer drum 150 by an operation of a solenoid 152 and winding the transfer paper therearound in cooperation with an attractive charging means 153, a transfer electrode 155, a cam 156 for on-off controlling a separation pawl 162, and a cam 157 for on-off controlling the gripper 151.

As described above, the color image forming apparatus in this embodiment employs a clamshell structure, and has an upper case member $K_2$ sharing a boundary K with and set openable with respect to a lower case member $K_1$, the process cartridge 130 being held slidably on support members 135, 136 fixed to an apparatus body.

Projections 137, 138 provided on the cartridge 130 are fitted slidably in slide grooves 139, 140 in these support members. Thus, the process cartridge 130 can be withdrawn easily with a handle (not shown) gripped by the hand, after a front door 220 of the apparatus body is opened. A reference numeral 221 denotes a knob used when the front door 220 is opened. A reference numeral 171 denotes a means for supplying transfer paper P, and the transfer paper P fed from a horizontal A-4 size cassette **172*a* by a feed roll 173 is supplied onto the transfer drum 150 via transfer rolls 174, 175, timing rolls 176 and a paper feed guide 177. On the transfer drum 150, the transfer paper P is wound firmly therearound owing to the operations of the gripper 151, presser 154 and magnetically attractive electrode 153. On the transfer paper P, a Y toner image, a M toner image and a C toner image are then transferred in a laminated state in sequence owing to the operation of the transfer electrode 155 and the rotations of the image retaining drum 120 and transfer drum 150. The transfer paper P retaining the toner images of said colors is separated by the separation pawl 162 and then sent to a fixing device 181 by a transfer belt 180. The transfer paper P subjected to the fixing of the images is discharged to a tray 183 via discharge rolls 182**.

A reference numeral 190 denotes a locking means for the lower and upper case members $K_1$, $K_2$, and 200 an opening position control means. In order to open the upper case member $K_2$ by rotating a handle 199 held by the hand around a shaft $P_O$ with respect to the lower case member $K_1$, a knob 191 of the locking means 190 is raised against a spring 192. As a result, an operating member 193 is turned clockwise around a shaft 194 to press down the upper front end portion of an interlocking member 195, so that the interlocking member 195 is turned counterclockwise around a shaft 196 against a spring 197. Consequently, the lower rear end portion of the interlocking member 195 and a locking member 198 are disengaged to render the upper case member $K_2$ upwardly openable by the handle 199. The upper case member $K_2$ is opened gently by the force of a spring 206 of the position control means 200.

The position control means 200 has a bar 202 supported rotatably at one end portion thereof on a shaft 201 provided on the lower case member $K_1$, and a bar 204 supported rotatably at one end portion thereof on a shaft 203 provided on the upper case member $K_2$, the other end portions of the bars 202, 204 being mounted rotatably on a common shaft 205 not supported on any of these case members. A spring 206 is provided between these shafts 201, 203, and the closing and opening of the upper case member $K_2$ is done gently owing to the damping effect based on the force of the spring 206. While the case member $K_2$ is closed, the bars 202, 204 in the position control means 200 are folded, and, as the case member $K_2$ is opened, the bars rise against the force of the spring 206. When the upper case member $K_2$ is opened (at 20°) normally, the two bars extend linearly in the vertical direction to stop the opening movement of and support the upper case member $K_2$.

In order to close the lower case, the bars 202, 204 in the position control means 200 are folded through the steps contrary to those mentioned above. During the case member closing operation, the lower end of the interlocking member 195 in the locking means 190 is kicked by the shoulder of the upper surface of the locking member 198 and turned, and the interlocking member 195 then engages the locking member 198 automatically owing to the force of the spring 197.

The above is a description of the construction of a color image forming apparatus having the process cartridge 130 in which the full color developing unit 122 for three colors Y, M, C is installed, and an image forming process carried out in the apparatus is as follows. During a first revolution of the image retaining drum 120, the optical information obtained by scanning the color document 100 with the optical system 102 is exposed on the image retaining drum through the B filter member in the change-over filter 109 to form an electrostatic latent image thereon, which is then developed by the Y developing device 125 to form a Y toner image. This image is transferred onto the A-4 size transfer paper fed horizontally from the cassette **172*a* around the transfer drum 150 via the paper feed means 171 so that the feeding of this paper coincides with the formation of the toner image. During a second revolution of the image retaining drum 120, the optical information is exposed on the image retaining drum 120 through the G filter member to form an electrostatic latent image thereon, which is then developed by the M developing device to form a M toner image. This M toner image is transferred onto the transfer paper P, which is moved with the transfer drum 150**, in such a manner that the M toner image is superposed on the above-mentioned Y toner image.

Similarly, the exposure through the R filter member and the development by the C developing device are carried out during a subsequent revolution of the image retaining drum 120 to form a C toner image, which is then transferred onto the transfer paper on the transfer drum so that the C toner image is superposed on the Y and M toner images, which are displayed circularly with the transfer drum, to form a multicolor toner image. The transfer paper P on which this multicolor toner image is retained is separated by the separation pawl 162 and sent by the transfer belt 180. This toner image is then fixed by a fixing device 181, and the transfer paper is sent out to the discharge tray 183 by the paper discharge rolls 182 to form a color image. This image retaining drum 120 is made clean by the cleaning device 129 every time the transferring of a toner image of a color is finished.

Figure 2B:
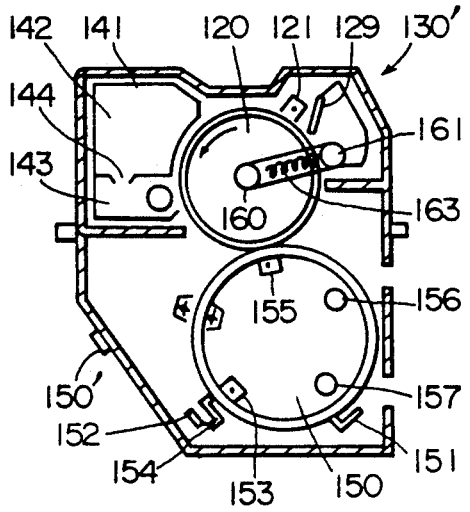

In this embodiment, the process cartridge 130 was provided therein with an IC card 150' on which the full color image forming process and the number of copies, i.e. 50000 representative of the limit of use of the cartridge 130 were registered. The information stored on the IC card was outputted to a CPU 215, and the image forming process was controlled through the CPU. The apparatus body was provided therein with a copy number counter 211 by which the number of copies was counted in accordance with the signals from a sensor 210, and the information on the counted number of copies was sent to the CPU 215, in which this number of copies was compared with that representative of the limit of use of the cartridge and read from the IC card 150'. When the counted number reached the limit number of 50000, the copying operation was interrupted, and the cartridge was withdrawn, which was replaced by a black-and-white image copying process cartridge 130' shown in FIG. 2B.

The cartridge 130' had a BK developing device 141, which consisted of a BK toner supply chamber 142, and a developing chamber 143, and a reference numeral 144 denotes a toner supply port. A black-and-white document was then placed on the document glass plate to carry out an operation of taking black-and-white copies as the next copying operation. The cartridge 130' was provided with an IC card 150' on which a black-and-white image forming process and the limit number of black-and-white copies, i.e. 80000 representative of the lifetime of the cartridge were registered. The information from the IC card 150' in this cartridge 130', i.e. the image forming process and the limit number of copies of 80000 registered thereon were outputted to the CPU 215, and a copying operation was carried out continuously as the actual ordinal number of copy from the counter 211 was compared with this limit number, until this ordinal number reached the limit number.

The supplemental supplying of toner was done by interchanging the toner supply cylinders 165, 166, 167 in a full color image forming operation, and from the toner supply chamber 142 in a black-and-white image forming operation, to enable a continuous copying operation. The waste toner was recovered from the image retaining drum into the hollow therein by using a spring coil in both an operation of taking full color copies and an operation of taking black-and-white copies.

The limit of use of the above-mentioned cartridge was set on the basis of the lifetime of the image retaining drum in use which consisted of an OPC photosensitive body, and this cartridge ensured that high-quality copies could be obtained at any time within the limit of use thereof.

In order to shift the mode of obtaining full color copies to a mode of obtaining black-and-white copies, the filter 109 in the optical system 102 was fixed in the position of the Nd filter member, and a process capable of obtaining one copy every time the image retaining drum 120 and transfer drum 150 made one turn was used. In order to carry out this copying mode shifting operation, the developing devices 122 may be made modular, and the modular developing device may be withdrawn unitarily and replaced by the BK developing device 141 instead of replacing the cartridge.

The effect of this embodiment will now be described. Since an analog system is employed, an optical reading system having a simple construction and manufactured at a low cost can be used, and the switching of a mode of obtaining full color copies to that of obtaining black-and-white copies can be done easily. Since the transfer drum is contained with image forming devices in the cartridge, the positioning of the image retaining drum and transfer drum can be done invariably, and a transfer step can be carried out stably at all times, so that the doubling of laminated toner images of different colors does not occur. Owing to the clamshell structure of this apparatus, the remedying of a jam and the replacing of the parts can be done easily.

(Example 2)

Figure 3A:
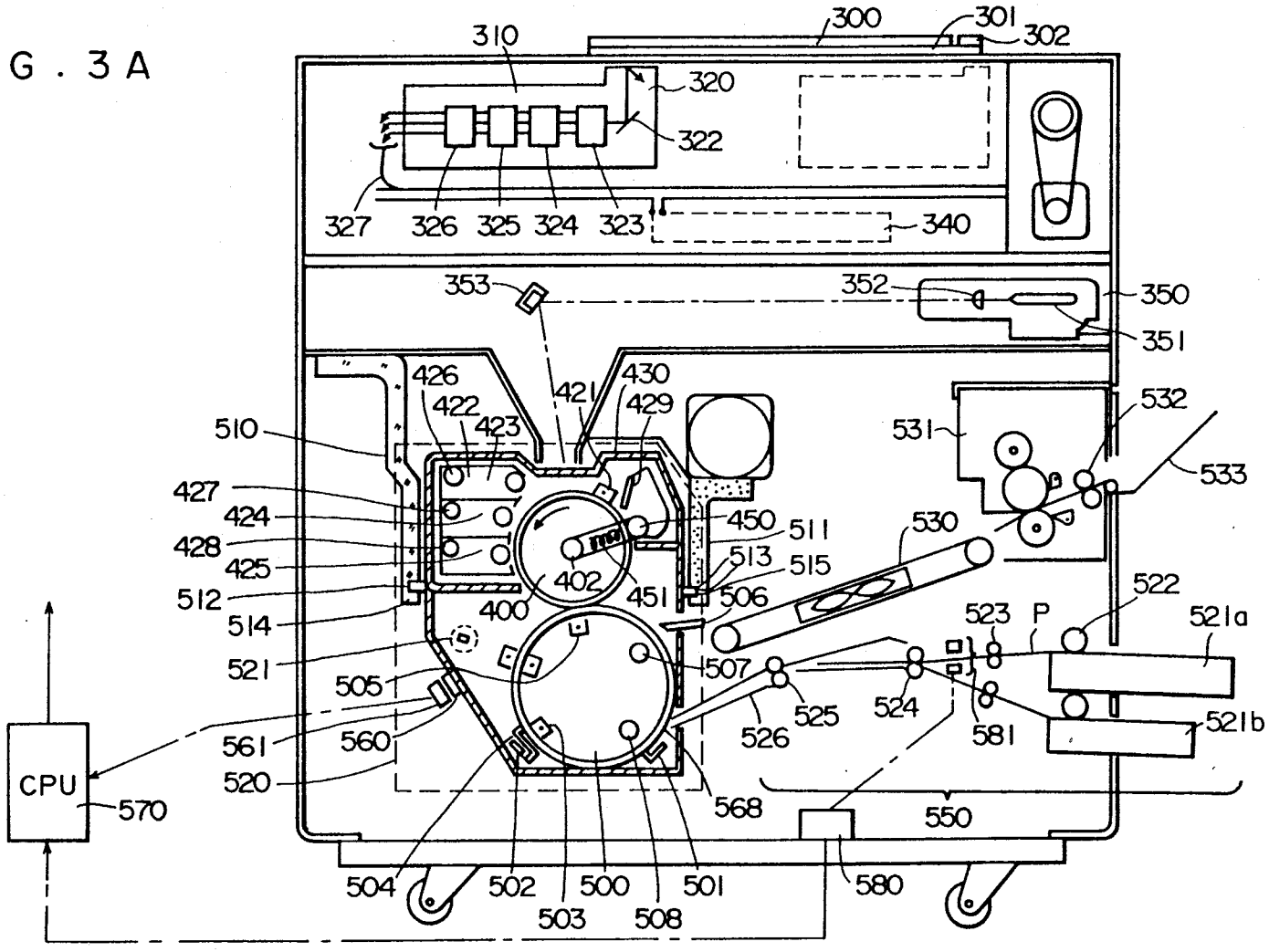
FIGS. 3A and 3B are a sectional view of another embodiment of the color image forming apparatus according to the present invention, and a sectional view of a principal portion of the apparatus.

FIG. 3A is a sectional view of a digital color image forming apparatus for describing this embodiment. In this embodiment, a functional color document 300 placed on a document glass plate 301 is read by a reading system, which will be described later, and written on an image retaining drum 400 with a laser beam modulated by a signal representative of what is thus read, to carry out the formation of an image. A reference numeral 310 in the reading system denotes a document scanning unit, in which the reflected light from a light source 320 is reflected on a reflector 322, separated into lights of two colors R, C by a color separation prism 323, and converted into electric signals of two systems R, C by a photoelectric converter 324 consisting of two CCDs. These signals are amplified in an amplifier 325, and converted into digital signals in an A/D converter 326. In an image processor 340, the digital signals of two systems R, C are processed in a color extraction information generating element to be extracted into three colors R, B, BK as recording signals of the three colors. These color recording signals are taken out sequentially to modulate a beam from a laser scanner 350, and the modulated laser beam is written on the image retaining drum 400. A reference numeral 351 denotes a polygon mirror, 352 a f-$\theta$ lens, and 353 a reflecting mirror.

A process cartridge 430 contains therein a developing device 422 including a R developing device 423, a B developing device 424 and a BK developing device 425, a charging device 421, a cleaning device 429 and a transfer drum. These developing devices are provided with toner supply cylinders 426, 427, 428, respectively, when a signal is generated in a residual toner quantity detector (not shown), the toner is supplemented by renewing a toner supply cylinder. The waste toner collected in a toner collector 450 in the cleaning device 429 is transferred to a hollow shaft 452 of the image retaining drum 400 by a spring coil 451 and recovered in the hollow in the same drum via a plurality of toner dropping holes provided in the hollow shaft 452.

A transfer drum 500 has a gripper 501 for fixing the front end portion of transfer paper to the same drum, a presser 504 for pressing the transfer paper against the transfer drum 500 by an operation of a solenoid 502 and winding the transfer paper therearound in cooperation with an attractive electrode 503, a transfer electrode 505, a cam 507 for on-off controlling a separation pawl 506, and a cam 508 for on-off controlling the gripper 501.

The process cartridge 430 is held slidably on support members 510, 511 fixed to an apparatus body. Projections 512, 513 provided on the cartridge 430 are fitted slidably in the slide grooves 514, 515 in the support members 510, 511. The cartridge 430 set in this manner can be withdrawn easily with a handle (not shown) gripped by the hand after a front door 520 of the apparatus body is opened by pulling a knob 521.

A reference numeral 550 denotes a means for supplying the transfer paper P. The transfer paper P fed from a horizontally disposed A-4 size cassette 521*d* by a paper feed roll 522 is sent onto the transfer drum 500 via transfer rolls 523, 524, timing rolls 525 and a paper feed guide 526. On the transfer drum 500, the transfer paper P is wound firmly thereon by the operations of the gripper 501, presser 504 and attractive electrode 503, and sent to a transfer region.

In the reading and writing systems, a R recording signal is taken out first, and a laser beam modulated by this R signal is used for the exposure of an image on the image retaining drum 400 in the process cartridge 430 to form an electrostatic latent image, which is reversally developed in a non-contacting manner by the R developing device 423 to form a R toner image. This toner image is transferred onto the transfer paper P, which is wound around and sent by the transfer drum, owing to the effect of the transfer electrode 505. During a subsequent revolution of the image retaining drum 400, the writing of a read image with a laser beam modulated by a B recording signal and the developing of the resultant image by the B developing device 424 are done in a similarly to form a B toner image on the image retaining drum 400, and this B toner image is then transferred onto the R toner image formed on and sent circularly by the transfer drum 500, in such a manner that the B toner image is superposed on the R toner image. The writing of a read image with a BK recording signal and the developing of the image by the BK developing device are also done similarly to form a BK toner image, which is then transferred onto the R and B toner images so as to be superposed thereon. The toner image-carrying transfer paper is separated by the separation pawl 506 and sent to a fixing device 531 by a transfer belt 530, and the toner image is fixed, the resultant transfer paper being sent out to a tray 533 by discharge rolls 532.

Figure 3B:
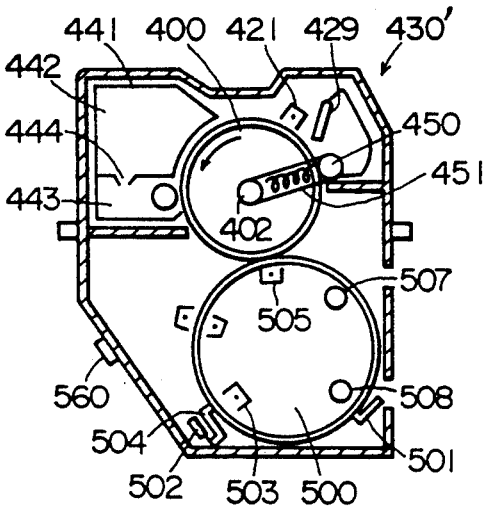

In this embodiment, the limit of use of the cartridge 430 is supposed to be 60000 in terms of number of copies taken. An IC card 560 on which a full color image forming process and this number of copies representing the limit of use of the cartridge are registered is provided on the cartridge 430, and this information on the IC card is read by a reading device 561 and outputted to a CPU 570. The apparatus body is provided therein with a counter 580, in which the number of copies is counted in accordance with the information from a sensor 581. A signal from the counter is outputted to the CPU, in which the number of copies represented by the signal is compared with that representative of the limit of use of the cartridge. When the actual ordinal number of copy reaches the limit number, the copying operation is interrupted and the process cartridge 430 is replaced by a black-and-white image copying cartridge 430′ shown in FIG. 3B. This process cartridge 430′ is provided thereon with an IC card on which a black-and-white image copying process and the number of copies, i.e. 90000 representative of the limit of use of the cartridge 430′ are stored. A black-and-white document 300′ is used instead of the functional color document 300. A developing device 441 in the process cartridge 430′ is provided with a BK toner chamber 442, a BK developing device 443 and a BK toner supply port 444. The black-and-white image copying process is read by using the reading system for the functional color image copying process, and it is determined in the image processor 340 that the information from the document is the information on the black-and-white image alone. The laser beam is modulated by a BK recording signal, and the writing of the information on the image retaining drum is done to form an electrostatic latent image. A copying operation is carried out continuously by the BK developing device 441 according to the predetermined process, in which one copy is taken per one revolution of the image retaining drum 400 and transfer drum 500, until the cartridge reaches its limit of use. The supplementation of the toner and the disposal of the waste toner are carried out in the same manner as in Example 1. Both the functional color copies and black-and-white copies obtained until the cartridge reached its limit of use proved to be of a high quality.

This embodiment has advantages in addition to those mentioned in Example 1, which are based on the image forming device transfer drum arranged in a cartridge. Namely, since a digital system is employed in Example 2, the changing of the quality of an image and the editing of an image can be done easily, and the range of utilization of the apparatus, especially, with respect to a color image copying operation is expanded.

(Example 3)

Figure 4A:
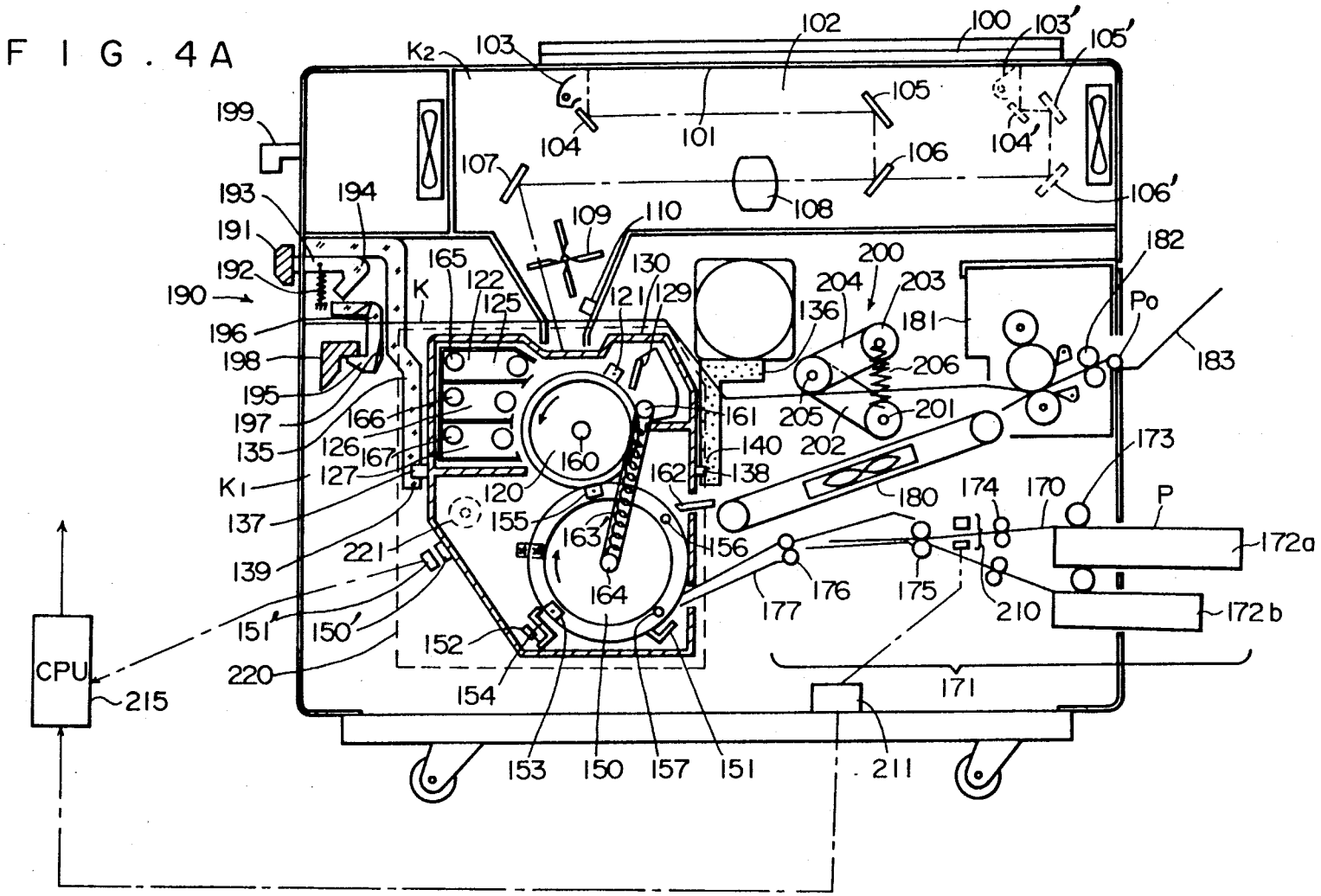
FIGS. 4A and 4B are a sectional view of a color image forming apparatus for describing still another embodiment of the present invention, and a sectional view of a principal portion of the apparatus.

FIG. 4A shows still another embodiment of the present invention, in which the waste toner brought together in a collector 161 is transferred to a hollow rotary shaft 164 of a transfer drum 150 by a spring coil 163′ and recovered in the hollow in the transfer drum 150 through a plurality of toner dropping holes provided in the rotary shaft 164.

Figure 5:
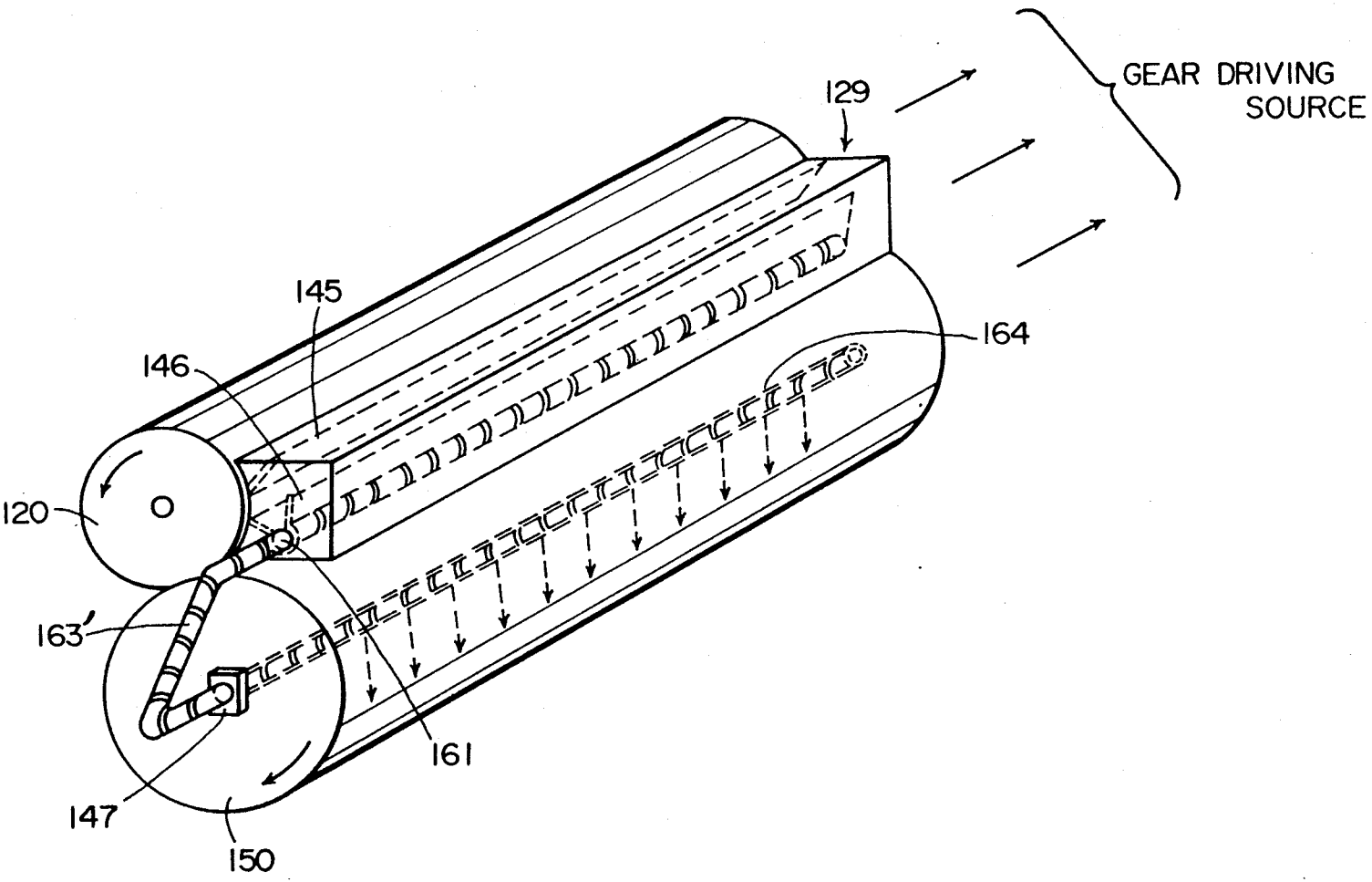
FIG. 5 is a perspective view of a principal portion of a waste toner recovering structure.

FIG. 5 is a perspective view illustrating a structure in which the waste toner in a cleaning device 129 is transferred by the spring coil 163′ and recovered in the transfer drum 150. Referring to the drawing, the residual toner on the surface of the image retaining drum 120 from which a toner image has already been transferred is scraped off by a cleaning blade 145 in a cleaning device 129 and brought together in a waste toner collector 146. This waste toner is transferred by the rotation of the spring coil 163′ provided in a waste toner transfer pipe 161 which has an upper opening in only the portion thereof which is within the cleaning device body. This waste toner transfer pipe 161 extends in the shape of the letter "U" and is joined to a flange 147 of the transfer drum 150.

The transfer drum is provided therein with a hollow shaft 164 constituting the rotary shaft thereof and supported rotatably on the flange 147. The spring coil 163' extends from the waste toner transfer pipe 161 to the terminal end of the hollow shaft 164, and is adapted to transfer the waste toner from the waste toner collector 146 to the hollow shaft 164 in the transfer drum 150. The hollow shaft is provided with a plurality of waste toner dropping holes, through which the waste toner is recovered in the hollow in the transfer drum 150.

The transfer drum 150 and spring coil 163' are rotated by the driving shaft of the image retaining drum via a transmission gear.

Figure 4B:
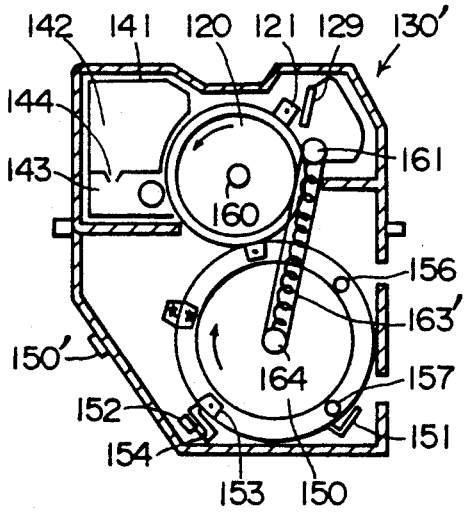
Figure 6B:
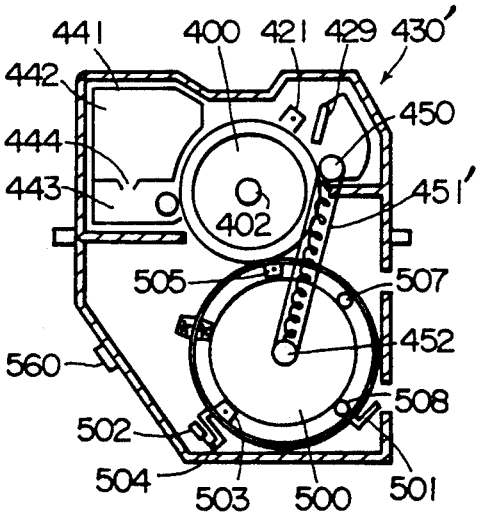

The ordinal number of a copy being taken was compared with the number of copies representative of the limit of use of the cartridge and outputted from the IC card 150'. When the former number reached the limit number of 70000, the copying operation is interrupted, and the lower case member $K_1$ was opened by an operation of the position control means 200. The cartridge was then withdrawn to be replaced by the black-and-white image copying process cartridge 130' shown in FIG. 4B.

This cartridge 130 has a BK developing device 141, which consists of a BK toner supply chamber 142 and a developing chamber 143, a reference numeral 144 denoting a toner supply port. A black-and-white document was then placed on the document glass plate, and a black-and-white image copying operation was carried out. The IC card 150' on which a black-and-white image forming process and the number of black-and-white copies of 80000 representative of the limit of use of this cartridge were registered was provided on the cartridge 130'. The information on this image forming process and this limit number of copies from the IC card 150' on the cartridge 130' was outputted to the CPU 215, and the copying operation was carried out continuously as the number of copies from the counter 211 was compared with this limit number of copies, until the cartridge reached the limit of use thereof.

In this embodiment, the waste toner in the cleaning device 129 is recovered in the large-capacity hollow in the transfer drum 150. This renders it unnecessary to interrupt a copying operation for the recovery of the waste toner, and enables the copying efficiency to be greatly improved.

(Example 4)

Figure 6A:
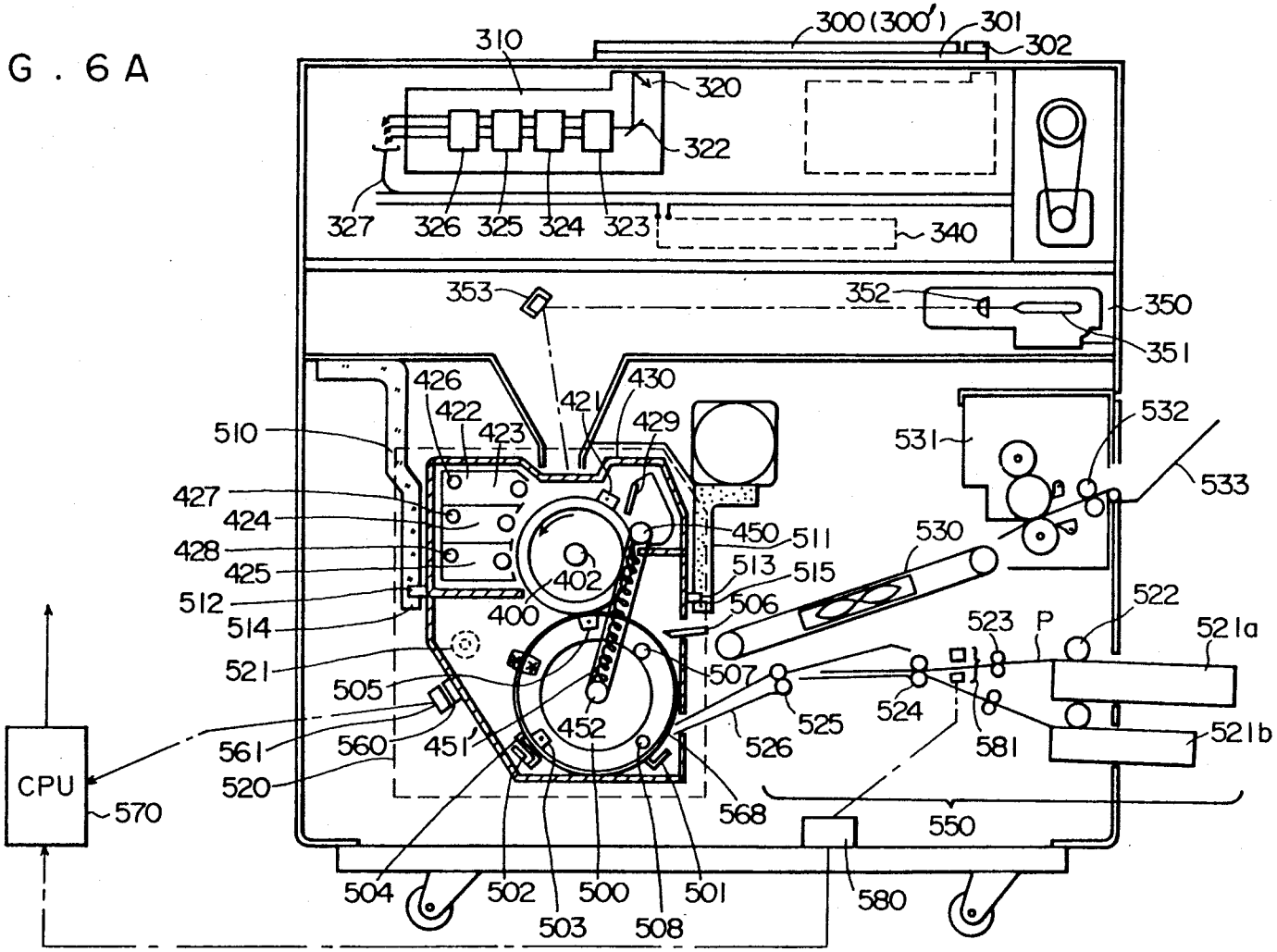
FIGS. 6A and 6B are a sectional view of a further embodiment of the color image forming apparatus according to the present invention, and a sectional view of a principal portion of the apparatus.

FIG. 6A shows a further embodiment of the present invention, in which the waste toner brought together in a toner collector 450 in a cleaning device 429 was carried to a hollow shaft 452 of a transfer drum 500 by a spring coil 451' and recovered in the hollow in the transfer drum 500 through a plurality of toner dropping ports provided in this hollow shaft.

Figure 1A:
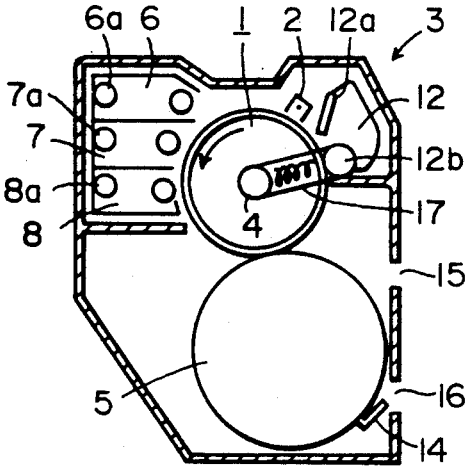
FIGS. 1A-1T are sectional views of various types of process cartridges usable in the present invention.
Figure 1B:
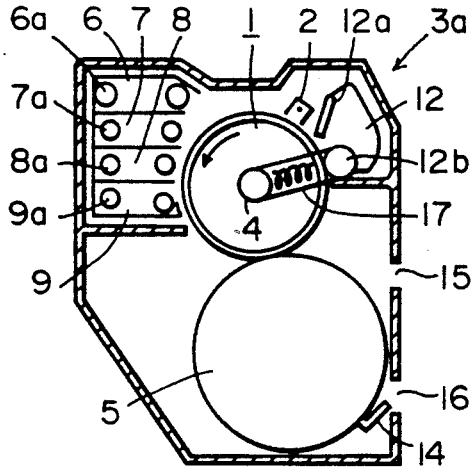
Figure 1C:
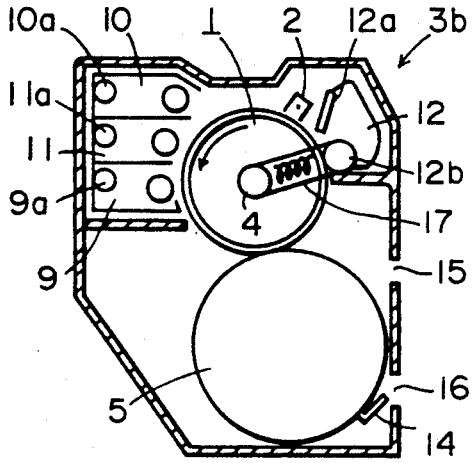
Figure 1D:
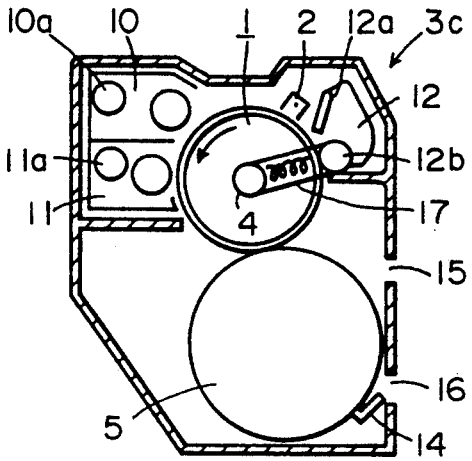
Figure 1E:
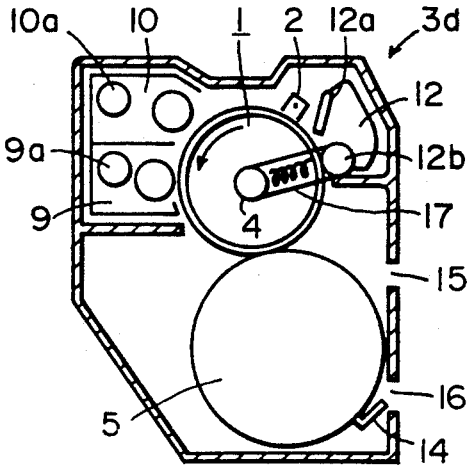
Figure 1F:
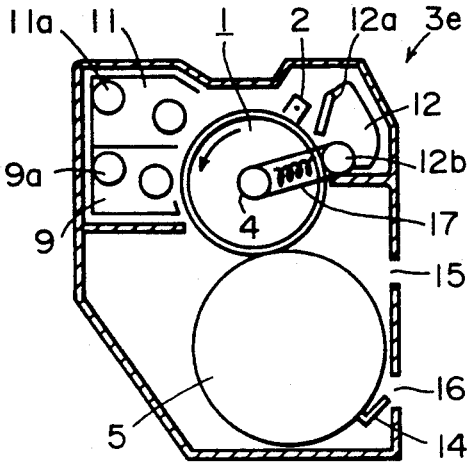
Figure 1G:
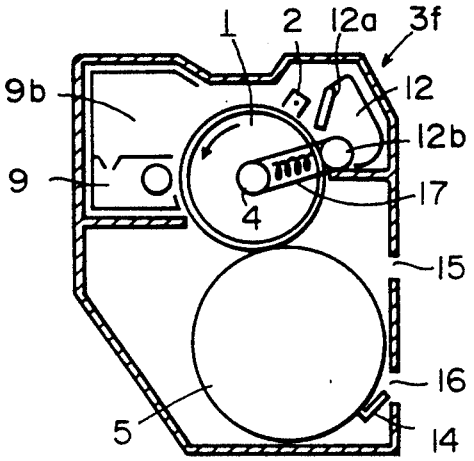
Figure 1H:
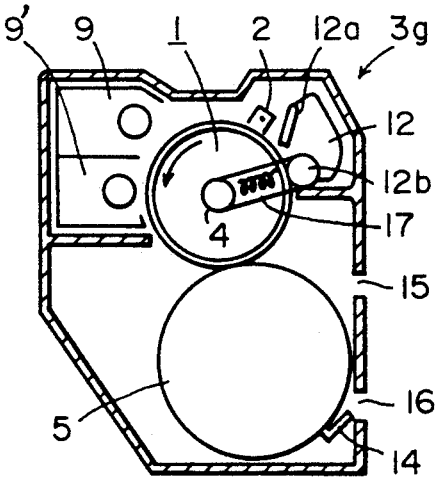
Figure 1I:
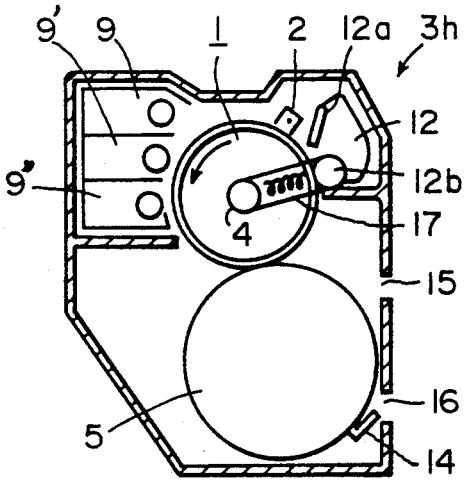
Figure 1J:
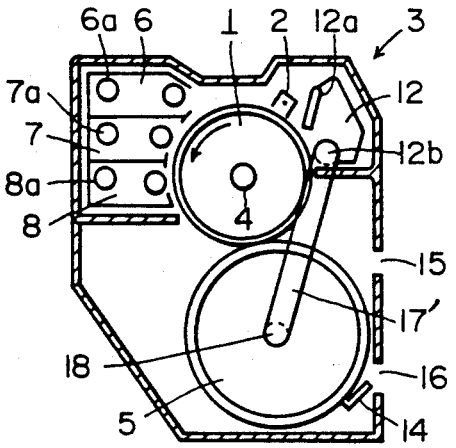
Figure 1K:
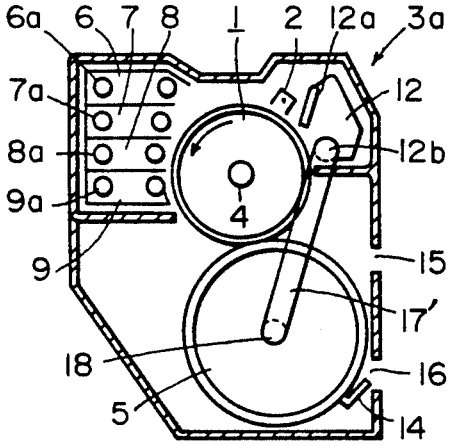
Figure 1L:
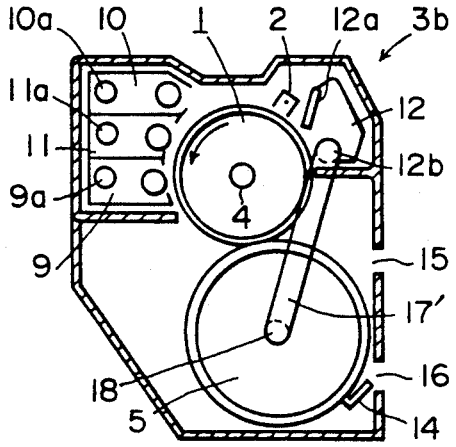
Figure 1M:
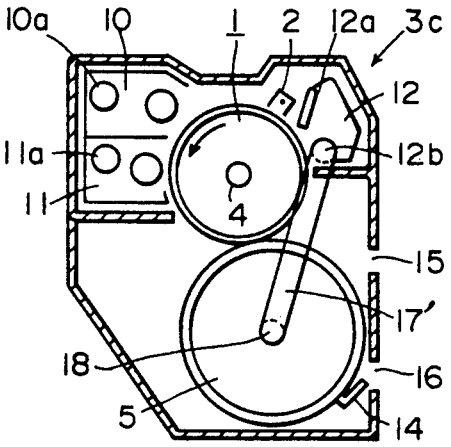
Figure 1N:
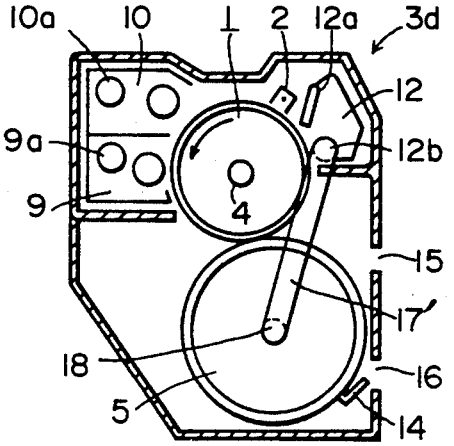
Figure 10:
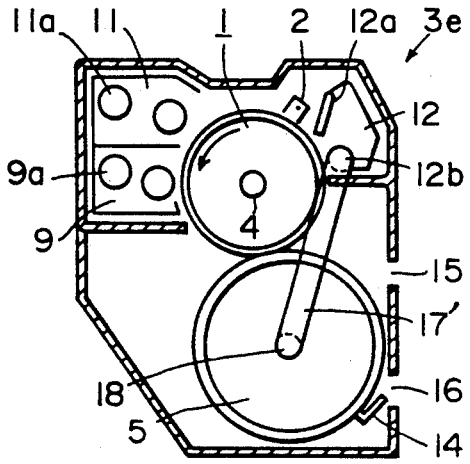
Figure 1P:
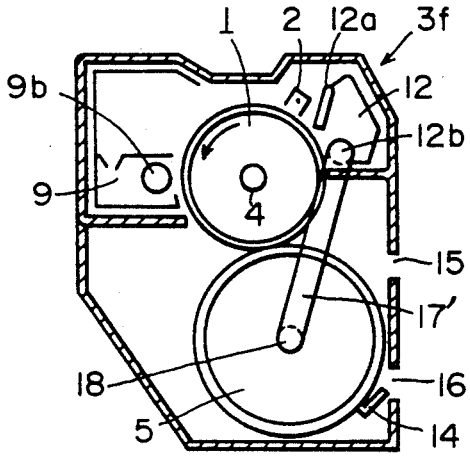
Figure 1Q:
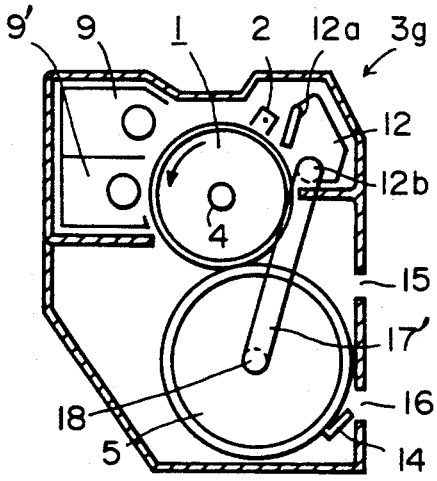
Figure 1R:
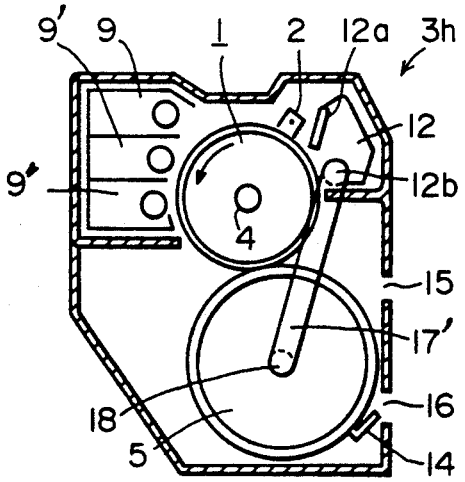
Figure 1S:
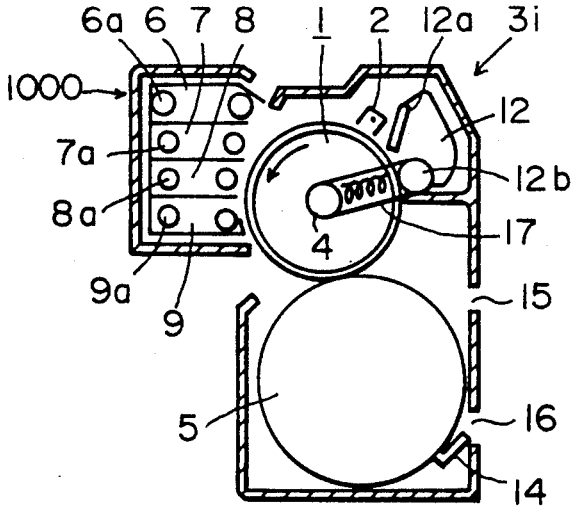
Figure 1T:
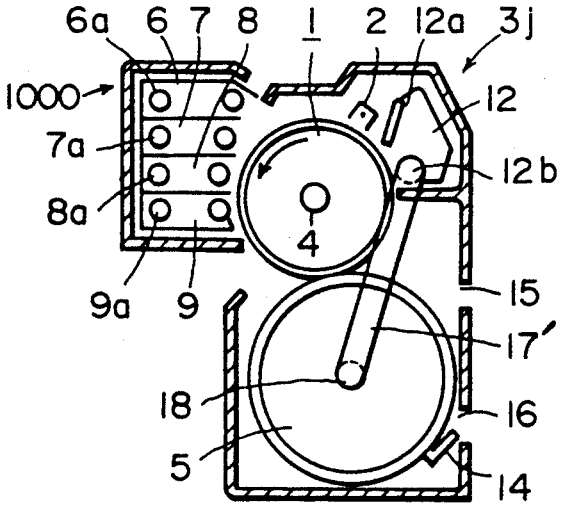

In the above embodiments, the process cartridge is formed so as to include a group of developing devices therein. However, a cartridge wherein a developing unit 1000 for the full color development is mounted separately from a process cartridge **3*i* or 3*j* including an image retaining drum 1, a transfer drum 5 etc. arranged unitarily, as shown in FIGS. 1S or 1T**.

The process cartridge including therein a group of developing devices has a construction for preventing toner or ozone from being scattered or emitted to the outside, so that operator can be replaced the process cartridge without soiling his hands and having a smell of the ozone. In case that a group of the developing devices is very large in overall weight because two-component developer is used, for example, it can be solved by arranging the group of the developing devices separately from the process cartridge **3*i* or 3*j***.

Further, it can be adapted to the various types of color recording, because only the group of the developing devices for required colors can easily be replaced.

Furthermore, in the above embodiments the image retainer and the transfer member of the drum type are explained, however, it is not limited thereto and the those of belt type may be used.

In the color image forming apparatus according to the present invention, the doubling, which is peculiar to a transfer operation by a transfer drum, of transferred image portions of different colors does not occur in a color image copying operation, so that the quality of a color copy can be ensured, and this apparatus can be made compact. This apparatus is also capable of switching a color image copying mode to a black-and-white image copying mode, so that not only color copies but also black-and-white copies which are in great demand can be obtained conveniently.

Since the waste toner in the cleaning device is recovered in the large-capacity hollow in the transfer drum in the cartridge, it is not necessary at all to carry out a waste toner recovering operation before the replacement of the cartridge, and this enables a copying operation to be carried out with an improved efficiency.

What is claimed is:

1. A color image forming apparatus comprising:

a plurality of developing devices, a cleaning device and a transfer member, all of which are provided around an image retainer;

at least the image retainer, the cleaning device and the transfer member being arranged unitarily in a process cartridge, and the process cartridge being formed so that it can be inserted into and withdrawn from an apparatus body; and a means for recovering waste toner, which is scraped off from a surface of the image retainer by the cleaning device, into a hollow in the transfer member.

2. The color image forming apparatus according to claim 1, wherein said process cartridge contains said plurality of developing devices.

3. The color image forming apparatus of claim 1, wherein said transfer member is arranged to hold a transfer paper to which a toner image formed on the image retainer is transferred.

4. The color image forming apparatus of claim 1, wherein said transfer member comprises a transfer drum.

5. The color image forming apparatus of claim 4, wherein said waste toner recovering means comprises a spring coil and said transfer drum includes a hollow rotary shaft having a plurality of toner dropping holes, the spring coil being arranged to recover collected wasted toner into the hollow rotary shaft.

6. The color image forming apparatus of claim 1, wherein said recovery means is arranged within said process cartridge.

7. The color image forming apparatus of claim 1, wherein said recovery means comprises a screw conveyor.

8. The color image forming apparatus of claim 1, wherein said recovery means comprises a spring coil.

9. The color image forming apparatus of claim 1, further comprising a waste toner transfer means provided on an outer side of said process cartridge.

* * * * *